US006905202B2

(12) United States Patent
Shimamoto et al.

(10) Patent No.: US 6,905,202 B2
(45) Date of Patent: Jun. 14, 2005

(54) INK-JET HEAD AND RECORDING APPARATUS

(75) Inventors: Keisuke Shimamoto, Kumamoto (JP); Makio Nobayashi, Kumamoto (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 69 days.

(21) Appl. No.: 10/371,554

(22) Filed: Feb. 21, 2003

(65) Prior Publication Data

US 2003/0231230 A1 Dec. 18, 2003

(30) Foreign Application Priority Data

Feb. 22, 2002 (JP) ..... 2002-045835

(51) Int. Cl.[7] ..... B41J 2/17
(52) U.S. Cl. ..... 347/94
(58) Field of Search ..... 347/94, 68–72

(56) References Cited

U.S. PATENT DOCUMENTS 5,943,079 A * 8/1999 Yoshida ..... 347/94
5,963,234 A * 10/1999 Miyazawa et al. ..... 347/70
5,984,459 A * 11/1999 Takahashi et al. ..... 347/70
6,142,616 A * 11/2000 Akahane ..... 347/71
6,332,672 B1 * 12/2001 Yazaki et al. ..... 347/70
6,361,155 B1 3/2002 Kanda et al. ..... 347/70
6,502,930 B1 * 1/2003 Shimada et al. ..... 347/71

FOREIGN PATENT DOCUMENTS

JP 9-314836 12/1997
JP 2001-63052 A 3/2001

* cited by examiner

*Primary Examiner*—K. Feggins
(74) *Attorney, Agent, or Firm*—Harness, Dickey & Pierce, P.LC.

(57) ABSTRACT

The ink-jet head of this invention includes a nozzle plate in which a nozzle is formed; a pressure chamber part in which a pressure chamber charged with an ink is formed; an ink passage part in which an ink supplying passage for supplying the ink to the pressure chamber is formed; a piezoelectric actuator for applying a pressure to the pressure chamber for discharging the ink from the nozzle; a damper wall for separating the ink supplying passage from an air chamber; and a communicating hole for communicating the air chamber with the atmospheric air.

14 Claims, 15 Drawing Sheets

INK-JET HEAD AND RECORDING APPARATUS

BACKGROUND OF THE INVENTION

The present invention relates to an ink-jet head and a recording apparatus.

One of conventionally known inkjet heads includes a pressure chamber charged with an ink, an ink supplying passage communicated with the pressure chamber for supplying the ink to the pressure chamber, a nozzle communicated with the pressure chamber through an ink discharging passage, and pressure applying means (an actuator) for applying a pressure to the pressure chamber. In such an ink-jet head, the pressure is applied to the pressure chamber by the pressure applying means, so as to discharge the ink charged in the pressure chamber from the nozzle.

In this ink-jet head, meniscus vibration is caused at the tip opening of the nozzle when the ink is discharged. Pressure waves caused by the vibration are propagated from the pressure chamber to the ink supplying passage. The pressure waves propagated to the ink supplying passage are also propagated to another pressure chamber communicated with this ink supplying passage, so that the ink may be discharged from another nozzle communicated with this other pressure chamber.

As a countermeasure, for example, Japanese Laid-Open Patent Publication No. 9-314836 discloses an ink-jet head including a damper wall as a top wall of an ink supplying passage. In this ink-jet head, an air chamber is provided in a position opposing an ink supplying passage, and a partition wall between the ink supplying passage and the air chamber is made from a flexible damper wall. Thus, when the pressure waves caused as described above are propagated to the ink supplying passage, the damper wall absorbs and eliminates the pressure waves. Therefore, the propagation of the pressure waves to another pressure chamber is avoided, so that an ink can be prevented from being discharged from another nozzle.

Such an ink-jet head is fabricated by jointing a plurality of stacked plate materials with one another. Also, the air chamber is a space enclosed with the damper wall. Therefore, the pressure within the air chamber is increased through heating performed in fabricating the ink-jet head and is lowered thereafter due to decrease of the temperature. As a result, in a completed ink-jet head, the damper wall remains to be deformed due to the pressure difference between the ink supplying passage and the air chamber. When the damper wall is thus deformed, the pressure waves propagated through the ink cannot be absorbed.

Furthermore, since the air chamber is an enclosed space, the air within the air chamber is expanded and shrunk in accordance with the ambient temperature change during the operation of the inkjet head. Therefore, the pressure within the air chamber is varied. As a result, the characteristic of the damper wall is varied, so that the pressure waves propagated through the ink supplying passage may not be definitely absorbed by the damper wall.

SUMMARY OF THE INVENTION

The present invention was devised in consideration of the aforementioned problems, and an object is improving the reliability of an ink-jet head and improving recording quality of a recording apparatus by improving the structure of an ink-jet head so as to prevent a damper wall from remaining to be deformed and prevent a pressure within an air chamber from varying in accordance with the ambient temperature change.

In order to achieve the object, according to the present invention, an air chamber is communicated with the atmospheric air.

Specifically, the ink-jet head of this invention includes a pressure chamber part in which a pressure chamber charged with an ink is formed; a nozzle plate in which a nozzle for discharging the ink is formed; an ink passage part disposed between the pressure chamber part and the nozzle plate in which an ink supplying passage communicated with the pressure chamber for supplying the ink to the pressure chamber and an ink discharging passage for communicating the pressure chamber with the nozzle are respectively formed; an actuator, stacked on the pressure chamber part, for applying a pressure to the pressure chamber for discharging the ink charged in the pressure chamber from the nozzle; an air chamber provided in the ink passage part in a position opposing the ink supplying passage; a damper wall with flexibility for separating the ink supplying passage from the air chamber; and a communicating hole for communicating the air chamber with the atmospheric air.

In the ink-jet head having the aforementioned structure, the air chamber is communicated with the atmospheric air through the communicating hole. Therefore, even when the temperature is changed during the fabrication of the ink-jet head, the pressure within this air chamber is always the atmospheric pressure. Accordingly, in the fabricated ink-jet head, the damper wall can be prevented from remaining to be deformed.

Also, even when the air within the air chamber is expanded/shrunk during the operation of the ink-jet head due to the ambient temperature change, since the air chamber is communicated with the atmospheric air, the pressure within the air chamber is always the atmospheric pressure. Accordingly, the characteristic of the damper wall can be always kept constant.

Therefore, pressure waves propagated to the ink supplying passage are definitely absorbed by the damper effect provided by the damper wall. As a result, the ink can be prevented from being discharged by the propagated pressure waves, so as to improve the reliability of the ink-jet head.

In this ink-jet head, the ink passage part may include a plurality of plate materials stacked between the nozzle plate and the pressure chamber part. In this case, the communicating hole may extend within the ink passage part in a direction perpendicular to a stacking direction and be opened on a side face of the ink passage part.

The communicating hole may consist of a plurality of long holes that are respectively formed to penetrate, in a thickness direction, given two adjacent plate materials out of the plurality of plate materials and are arranged in a line at substantially equal intervals. In this case, the long holes formed in one of the two plate materials are preferably shifted in positions thereof in a lining direction from the long holes formed in the other of the two plate materials in such a manner that an end of one long hole formed in one plate material is communicated with an end of another long hole formed in the other plate material when the two plate materials are stacked.

In other words, the communicating hole is preferably formed in the two plate materials alternately in the stacking direction (which herein means a direction for stacking components or plate materials included in an ink-jet head). Thus, through holes are merely formed to be arranged in a line in each plate material. Therefore, lowering of the strength of each plate material attained before stacking them can be suppressed. As a result, the plate materials can be easily dealt with in the fabrication of the ink-jet head.

Alternatively, the communicating hole may be an expanding slot that is formed in a given plate material out of the plurality of plate materials and is opened at an end of the given plate material.

In this case, the communicating hole is preferably formed in a zigzag manner from the air chamber to the side face of the ink passage part. Thus, the lowering of the strength of the plate material can be suppressed as compared with the case where the expanding slot is linearly formed. Therefore, the plate materials can be easily dealt with in the fabrication of the ink-jet head.

Also, the communicating hole may extends within the ink passage part in a stacking direction and be opened on an exposed face of the nozzle plate. Alternatively, the communicating hole may extend within the ink passage part in a stacking direction and be opened on an exposed face of the pressure chamber part.

In such a case, the communicating hole can be formed by forming through holes in the respective plate materials included in the ink passage part so as to communicate with each other when the plate materials are stacked. Therefore, the strength of the plate materials attained before stacking them is not lowered, and hence, the plate materials can be easily dealt with in the fabrication of the ink-jet head.

The ink supplying passage may includes a plurality of ink supplying passages for respectively supplying inks of different colors, the air chamber may include a plurality of air chambers, respectively corresponding to the plurality of ink supplying passages, separated by the damper wall, and the communicating hole may include a plurality of communicating holes respectively corresponding to the plurality of air chambers.

Furthermore, each of the plurality of ink supplying passages for the inks of different colors may further include a plurality of ink supplying passages, the air chamber may include a plurality of air chambers, respectively corresponding to the plurality of ink supplying passages for the inks of different colors, separated by the damper wall, and the communicating hole may include a plurality of communicating holes respectively corresponding to the plurality of air chambers. Specifically, the air chamber is provided correspondingly to each of the ink supplying passages, and the communicating hole is provided correspondingly to each of the air chambers.

Thus, the pressure within the air chamber provided correspondingly to each ink supplying passage can be always the atmospheric pressure. Therefore, the pressure waves propagated to each ink supplying passage can be definitely absorbed by the damper wall.

A port for communicating the communicating hole with the air chamber is preferably disposed to have an edge thereof in a position away from the damper wall in a stacking direction.

If the port is constructed from the damper wall, the port (opening space) is in contact with the damper wall in the stacking direction, and therefore, a part of the periphery of the damper wall cannot be fixed. When a part of the periphery of the damper wall is thus not fixed, strain is caused in deformation of the damper wall, and therefore, the pressure waves cannot be definitely absorbed.

Accordingly, the port is disposed to have the edge thereof in the position away from the damper wall in the stacking direction. Thus, the whole periphery of the damper wall can be fixed. As a result, the damper wall can be uniformly deformed, so that the pressure waves can be definitely absorbed.

A protection part is preferably disposed between the ink passage part and the nozzle plate for protecting the communicating hole.

The ink-jet head is fabricated by jointing the actuator, the pressure chamber part and the ink passage part to one another and then jointing the nozzle plate to the resultant. Since the ink-jet head of this invention includes the communicating hole, there is a space within the ink passage part. Therefore, the strength is lowered in this space.

Accordingly, the protection part is disposed between the ink passage part and the nozzle plate. Thus, the communicating hole (namely, the space) can be protected by the protection part, and hence, the components can be easily dealt with in jointing the nozzle plate.

A second air chamber and a second communicating hole for communicating the second air chamber with the atmospheric air may be formed in the protection part.

Assuming that the second air chamber and the second communicating hole are not formed in the protection part, the air present between the nozzle plate and the protection part expands in jointing the nozzle plate to the protection part. Therefore, an adhesive applied between the nozzle plate and the protection part flows out. As a result, a void is caused in a joint layer between the nozzle plate and the protection part after the adhesion, and nozzles of the nozzle plate may be communicated with each other through the void.

Therefore, the second air chamber and the second communicating hole are formed in the protection part. Thus, the air expanded between the nozzle plate and the protection part escapes to the outside from the second air chamber through the second communicating hole. As a result, a void can be prevented from being caused in the joint layer between the nozzle plate and the protection part.

The communicating hole and the second communicating hole are preferably shifted in positions thereof in a direction perpendicular to a stacking direction.

In the fabrication of the ink-jet head, the ink passage part and the protection part are stacked and jointed to each other by heating them under a pressure applied in the stacking direction.

If the communicating hole and the second communicating hole are formed in the same position in a direction perpendicular to the stacking direction, a space formed by the communicating hole and a space formed by the second communicating hole are adjacent to each other in the stacking direction. In this case, even when the pressure is applied to the ink passage part and the protection part stacked on each other, the pressure cannot be definitely transmitted in the stacking direction. As a result, a joint failure may be caused.

Therefore, the communicating hole and the second communicating hole are arranged to be shifted in their positions in the direction perpendicular to the stacking direction. Thus, the space formed by the communicating hole and the space formed by the second communicating hole are never adjacent to each other in the stacking direction. In this case, the pressure applied to the ink passage part and the protection part stacked on each other can be definitely transmitted in the stacking direction. As a result, these parts can be definitely jointed to each other.

Each of the ink passage part and the protection part may include a plurality of plate materials stacked on one another.

In this case, the communicating hole may consist of a plurality of long holes that are respectively formed to penetrate, in a thickness direction, given two adjacent plate materials out of the plurality of plate materials included in the ink passage part and are arranged in a line at substantially equal intervals, the long holes formed in one of the two plate materials being shifted in positions thereof in a lining direction from the long holes formed in the other of the two plate materials in such a manner that an end of one long hole formed in one plate material is communicated with an end of another long hole formed in the other plate material when the two plate materials are stacked. Also, the second communicating hole may consist of a plurality of long holes that are respectively formed to penetrate, in the thickness direction, given two adjacent plate materials out of the plurality of plate materials included in the protection part and are arranged in a line at substantially equal intervals, the long holes formed in one of the two plate materials being shifted in positions thereof in the lining direction from the long holes formed in the other of the two plate materials in such a manner that an end of one long hole formed in one plate material is communicated with an end of another long hole formed in the other plate material when the two plate materials are stacked.

In this case, each long hole of the second communicating hole and each long hole of the communicating hole are preferably disposed in positions opposing each other in the stacking direction and shifted from each other in the lining direction.

In this case, the communicating hole and the second communicating hole are disposed to be adjacent to each other in the stacking direction. However, each long hole (space) of the communicating hole and each long hole (space) of the second communicating hole are never adjacent to each other in the stacking direction. Therefore, when the pressure is applied to the ink passage part and the protection part stacked on each other, the pressure can be definitely transmitted in the stacking direction. As a result, the ink passage part and the protection part can be definitely jointed to each other.

Another ink-jet head of this invention includes a pressure chamber charged with an ink; an ink supplying passage communicated with the pressure chamber for supplying the ink to the pressure chamber; a nozzle communicated with the pressure chamber through an ink discharging passage; an actuator for applying a pressure to the pressure chamber for discharging the ink charged in the pressure chamber from the nozzle; a damper wall with flexibility disposed as one of partition walls for separating the ink supplying passage; an air chamber provided on a side of the damper wall opposite to the ink supplying passage; and a communicating hole for communicating the air chamber with the atmospheric air.

Still another ink-jet head of this invention includes a nozzle; a pressure chamber communicated with the nozzle and charged with an ink; an ink supplying passage communicated with the pressure chamber for supplying the ink to the pressure chamber; pressure applying means for applying a pressure to the pressure chamber for discharging the ink from the nozzle; and pressure absorbing means including an air chamber for absorbing pressure variation of the ink within the ink supplying passage. The air chamber of the pressure absorbing means is communicated with the atmospheric air.

The recording apparatus of this invention includes an ink-jet head for performing recording by jetting ink drops onto a recording medium from a nozzle of the ink-jet head.

In this recording apparatus, the inkjet head includes a pressure chamber part in which a pressure chamber charged with an ink is formed; a nozzle plate in which the nozzle for discharging the ink is formed; an ink passage part disposed between the pressure chamber part and the nozzle plate, in which an ink supplying passage communicated with the pressure chamber for supplying the ink to the pressure chamber and an ink discharging passage for communicating the pressure chamber with the nozzle are respectively formed; an actuator, stacked on the pressure chamber part, for applying a pressure to the pressure chamber for discharging the ink charged in the pressure chamber from the nozzle; an air chamber provided in the ink passage part in a position opposing the ink supplying passage; a damper wall with flexibility for separating the ink supplying passage from the air chamber; and a communicating hole for communicating the air chamber with the atmospheric air.

In the recording apparatus having this structure, pressure waves propagated from the nozzle of the ink-jet head through the pressure chamber to the ink supplying passage can be definitely absorbed by the damper wall. Therefore, the ink can be prevented from being discharged by the propagated pressure waves. As a result, the recording apparatus can attain improved recording quality.

In another recording apparatus of this invention, the ink-jet head includes a pressure chamber charged with an ink; an ink supplying passage communicated with the pressure chamber for supplying the ink to the pressure chamber; the nozzle communicated with the pressure chamber through an ink discharging passage; an actuator for applying a pressure to the pressure chamber for discharging the ink charged in the pressure chamber from the nozzle; a damper wall with flexibility disposed as one of partition walls for separating the ink supplying passage; an air chamber provided on a side of the damper wall opposite to the ink supplying passage; and a communicating hole for communicating the air chamber with the atmospheric air.

In still another recording apparatus of this invention, the inkjet head includes a pressure chamber communicated with the nozzle and charged with an ink; an ink supplying passage communicated with the pressure chamber for supplying the ink to the pressure chamber; pressure applying means for applying a pressure to the pressure chamber for discharging the ink from the nozzle; and pressure absorbing means including an air chamber for absorbing pressure variation of the ink within the ink supplying passage, and the air chamber of the pressure absorbing means is communicated with the atmospheric air.

DETAILED DESCRIPTION OF THE INVENTION

Preferred embodiments of the invention will now be described with reference to the accompanying drawings.

Embodiment 1

Figure 1:
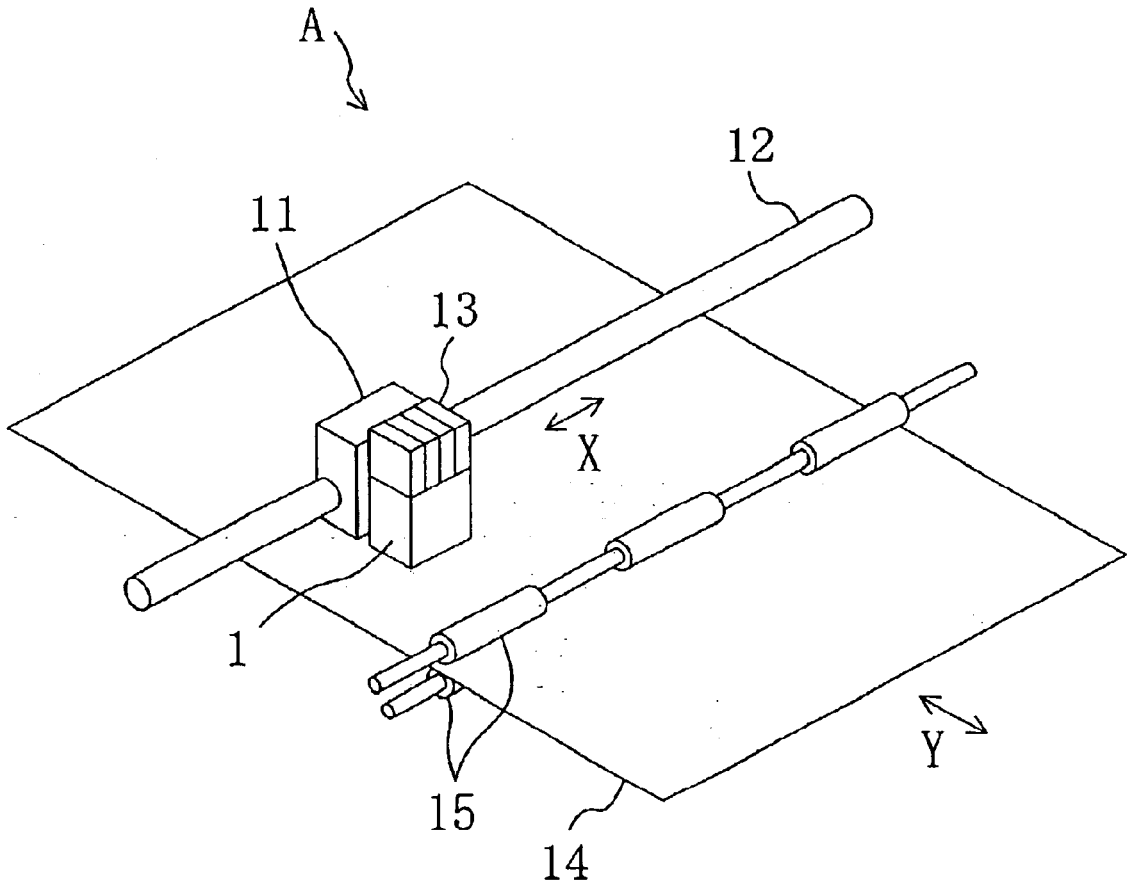
FIG. 1 is a schematic perspective view of an ink-jet type recording apparatus according to an embodiment of the invention.
Figure 2:
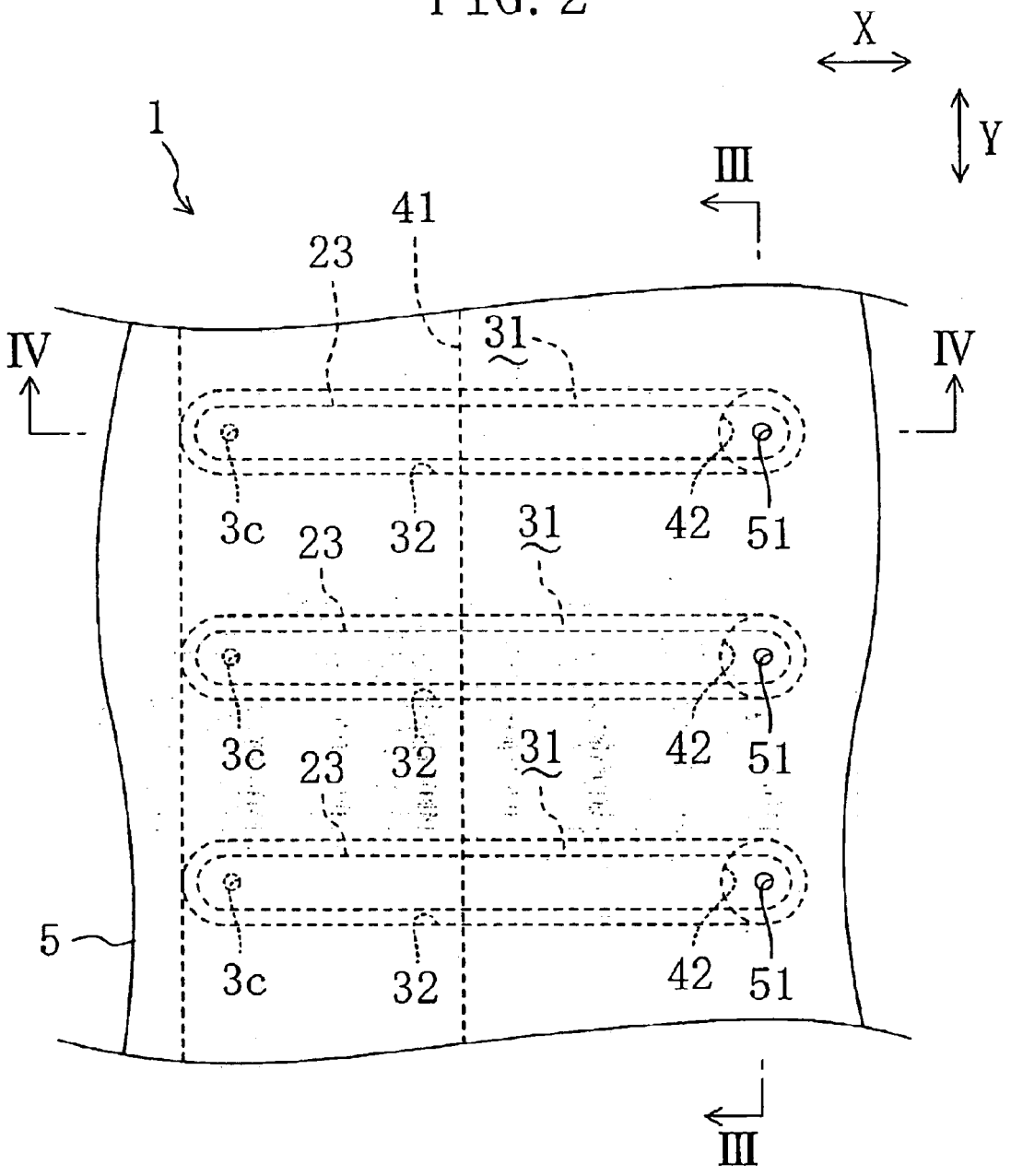
FIG. 2 is a partial bottom view of an ink-jet head.
Figure 3:
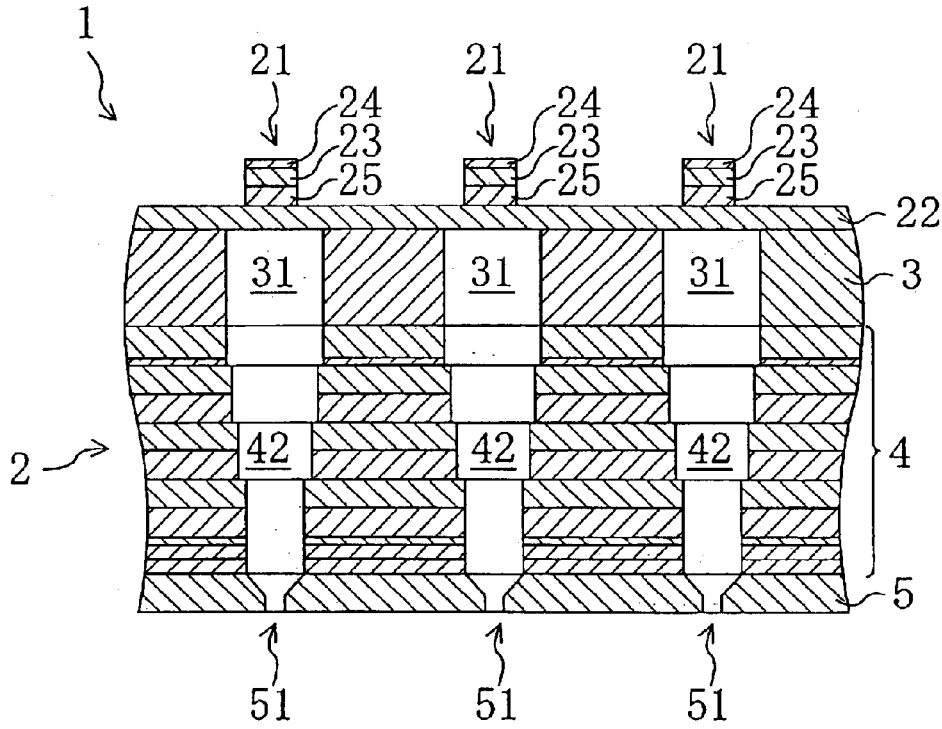
FIG. 3 is a cross-sectional view taken on line III—III of FIG. 2.
Figure 4:
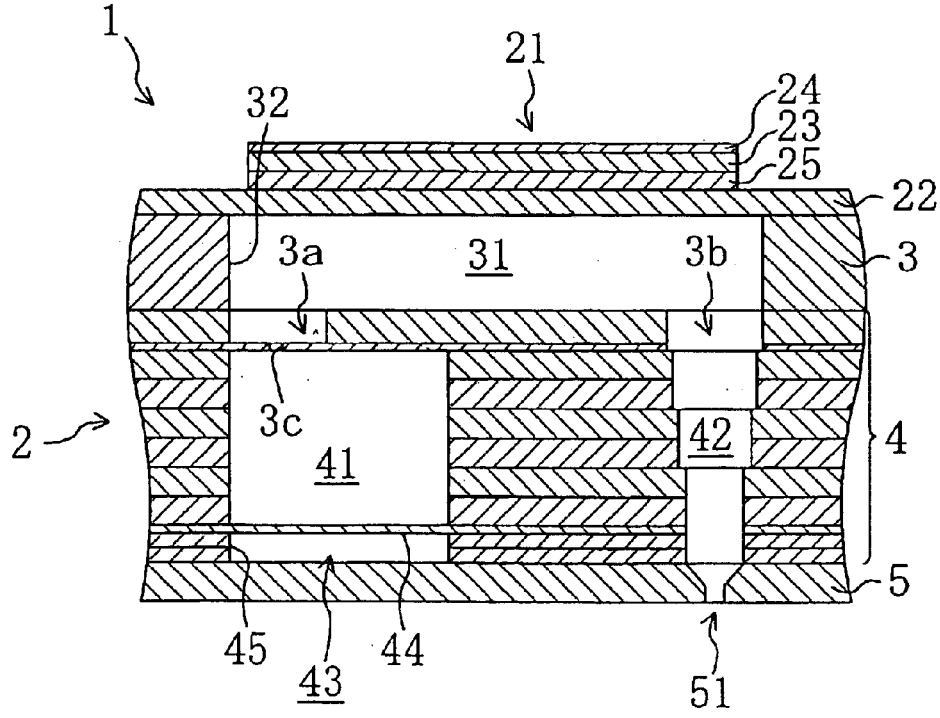
FIG. 4 is a cross-sectional view taken on line IV—IV of FIG. 2.
Figure 5:
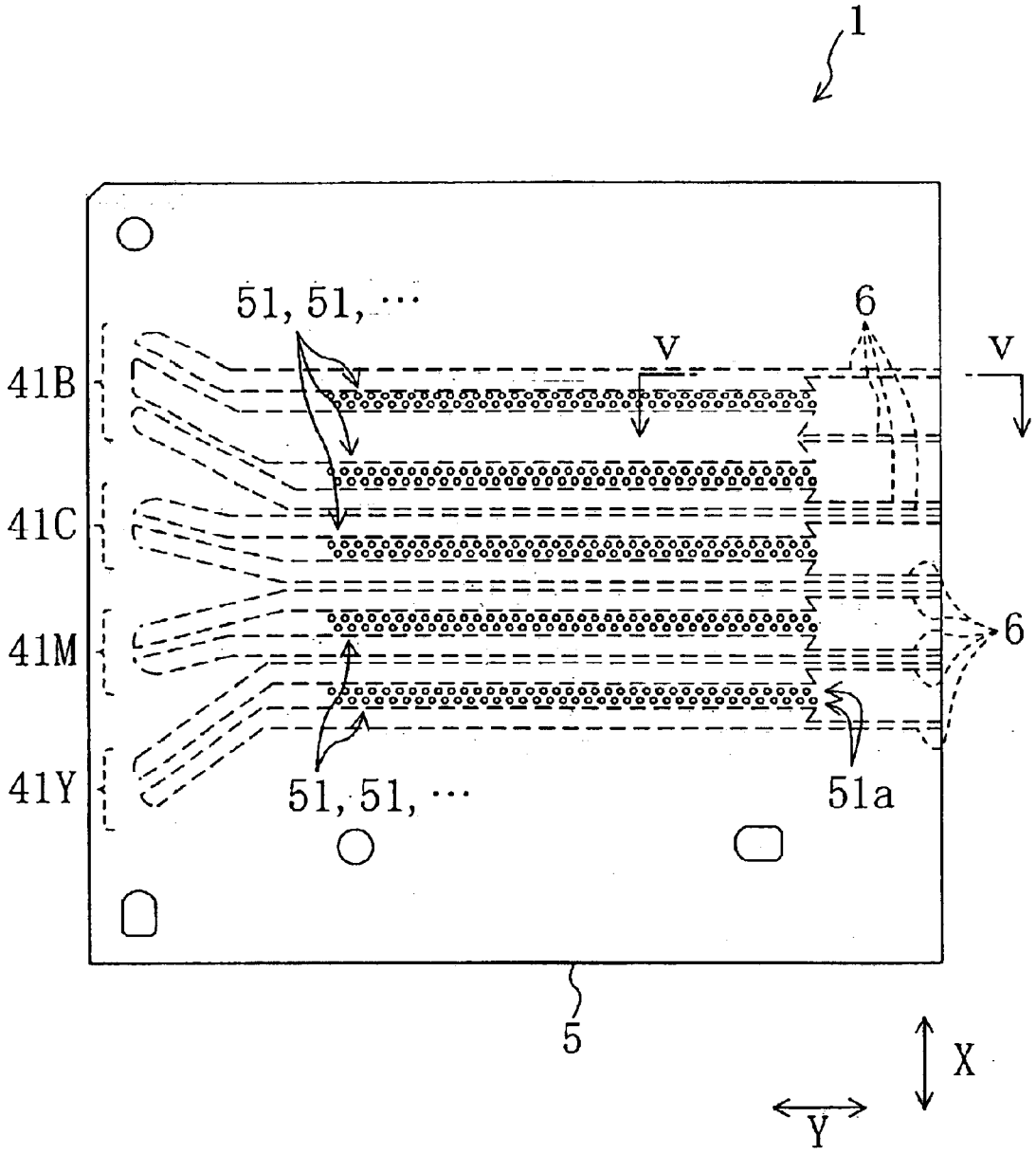
FIG. 5 is a bottom view of an ink-jet head according to Embodiment 1 of the invention.

FIG. 1 shows the outline of an ink-jet type recording apparatus A according to an embodiment of the invention. This recording apparatus A includes an ink-jet head for jetting ink drops onto a recording paper 14. On the ink-jet head 1, four ink cartridges 13 respectively containing inks of four colors, that is, black, cyan, magenta and yellow, are mounted. The ink-jet head 1 is fixedly supported on a carriage 11. The carriage 11 is provided with a carriage motor not shown. The ink-jet head 1 and the carriage 11 are guided by a carriage axis 12 extending along a primary scanning direction (namely, a direction X in FIGS. 1 and 2) to be reciprocated along this direction by the carriage motor.

The recording paper 14 is sandwiched between two transfer rollers 15 driven to rotate by a transfer motor not shown. The recording paper 14 is transferred by the transfer motor and the transfer rollers 15 below the ink-jet head 1 in a secondary scanning direction (namely, a direction Y in FIGS. 1 and 2) perpendicular to the primary scanning direction.

The ink jet head 1 includes, as shown in FIGS. 2 through 6, a head body 2 that has pressure chamber recesses 32 formed in an upper portion thereof (namely, on the upper side in FIG. 3 or 4), nozzles 51 formed in a lower portion thereof (namely, on the lower side in FIG. 3 or 4) and ink supplying passages 41 formed between the pressure chamber recesses 32 and the nozzles 51.

The ink supplying passages 41 are communicated with the ink cartridges 13 of the respective colors so as to be supplied with the inks from the ink cartridges 13. The ink supplying passages 41 include nine passages in total, that is, three passages for the black ink (referred to as 41B) and two passages for each of the cyan, magenta and yellow inks (respectively referred to as 41C, 41M and 41Y). The nine ink supplying passages 41 are provided so as to extend in the secondary scanning direction and to be spaced out from each other in the primary scanning direction.

Each ink supplying passage 41 is made from an ink passage part 4 including eleven stacked stainless steel thin plates (hereinafter sometimes referred to as plate materials). In the ink passage part 4, orifices 3*c* and ink discharging passages 42 are formed.

The orifices 3*c* are arranged on the top wall of the ink supplying passage 41 at substantially equal intervals in the secondary scanning direction. Each orifice 3*c* is communicated with a supply port 3*a* for supplying the ink to the pressure chamber recess 32 (pressure chamber 31). Each orifice 3*c* is formed in the second stainless steel thin plate from the top having a smaller thickness than the other stainless steel thin plates, and has a diameter of approximately 38 $\mu$m.

The ink discharging passages 42 are disposed in positions on one side of the ink supplying passage 41 at substantially equal intervals in the secondary scanning direction. Each ink discharging passage 42 communicates a discharge port 3*b* for discharging the ink from the pressure chamber recess 32 (pressure chamber 31) with the nozzle 51. Through holes formed in the respective plate materials for forming each ink discharging passage 42 are successively reduced in their diameters in the downward direction, so that steps can be formed on the inner side walls of each ink discharging passage 42.

The ink passage part 4 also includes air chamber recesses 45 opening downward correspondingly to the ink supplying passages 41 (41B, 41C, 41M and 41Y). Each air chamber recess 45 is disposed in a position opposing the ink supplying passage 41 in a stacking direction so as to extend in the secondary scanning direction. Each air chamber recess 45 is closed by jointing a nozzle plate 5 described later to the bottom face of the ink passage part 4, so as to form an air chamber 43.

The ink supplying passage 41 and the air chamber 43 are separated by one stainless steel thin plate having a smaller thickness (of approximately 10 $\mu$m) than the other stainless steel thin plates. Thus, the bottom wall of the ink supplying passage 41 is constructed from a damper wall 44 with flexibility.

The ink passage part 4 further includes communicating holes 6 for communicating the air chambers 45 with the atmospheric air. Each communicating hole 6 extends from one end of the air chamber 43 (one end opposite to the end connected to the ink cartridge 13) in the secondary scanning direction so as to be opened on the side face of the ink passage part 4.

Figure 6:
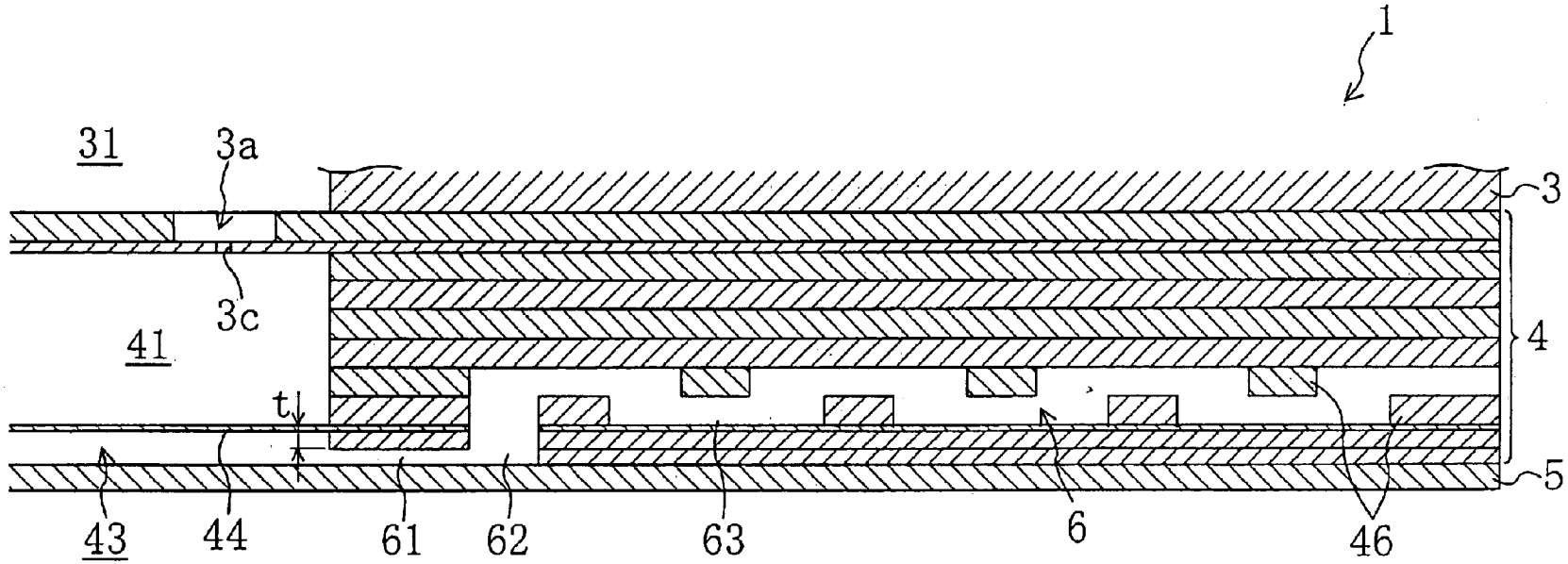
FIG. 6 is a cross-sectional view taken on line V—V of FIG. 5.
Figure 7:
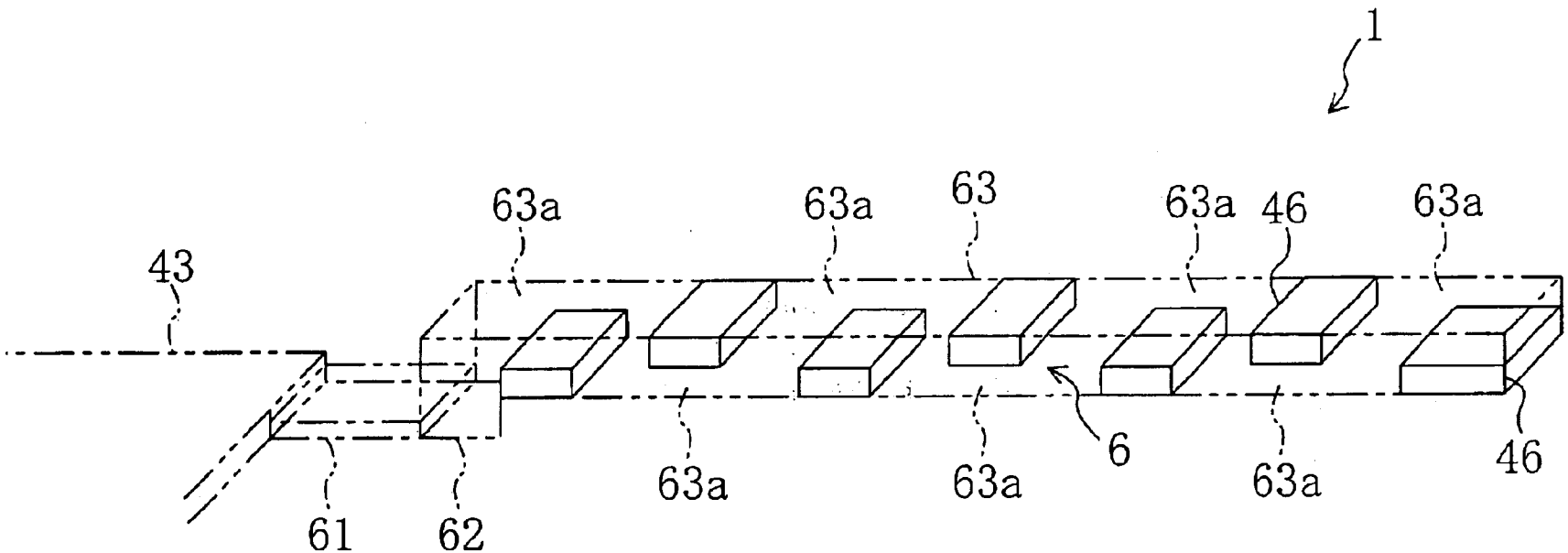
FIG. 7 is a perspective explanatory diagram for showing the structure of a communicating hole of Embodiment 1.
Figure 8:
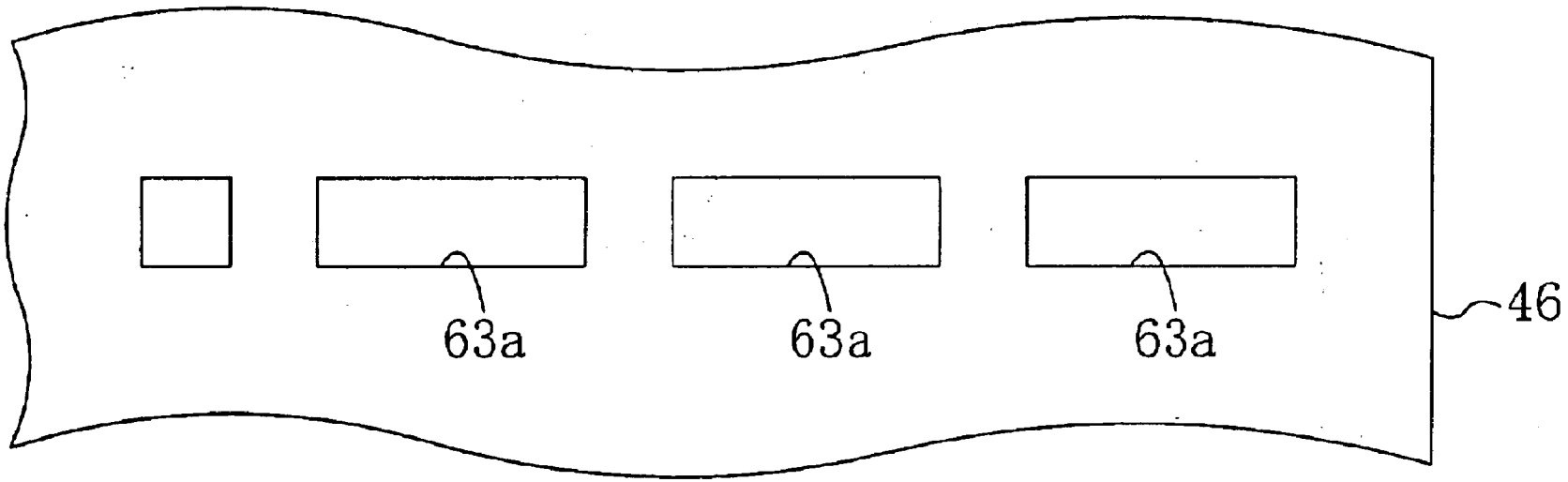
FIG. 8 is a plan view of an ink passage part in which long holes are formed.

As shown in FIGS. 6 through 8, each communicating hole 6 consists of a first communicating section 61 opened on the side wall of the air chamber 43 and extending in the secondary scanning direction, a second communicating section 62 connected to the end of the first communicating section 61 and extending in the upper direction in the ink passage part 4 and a main section 63 connected to the upper end of the second communicating section 62 and extending in the secondary scanning direction in the ink passage part 4 so as to be opened on the side face of the head body 2.

The first communicating section 61 of the communicating hole 6 is constructed from a through hole formed in the lower plate material out of the two plate materials positioned below the plate material used as the damper wall 44. Therefore, a port of the first communicating section 61 opened to the air chamber 43 is disposed to have an edge in a position away from the damper wall 44 in the stacking direction by a distance corresponding to the thickness of the plate material (shown as a distance t in FIG. 6).

The second communicating section 62 of the communicating hole 6 is constructed from through holes respectively formed, so as to be communicated with one another in the stacking direction, in the four plate materials, that is, the plate material used as the damper wall 44, one plate material disposed on and two plate materials disposed below the plate material use as the damper wall 44.

The main section 63 of the communicating hole 6 is constructed from through holes formed respectively in the two plate materials disposed above the plate material used as the damper wall 44. Specifically, as shown in FIG. 8, each of these two plate materials is provided with a plurality of long holes 63*a* arranged in a line at substantially equal intervals and penetrating the plate material in the thickness direction. FIG. 8 shows the lower plate material 46 out of the two plate materials. The respective long holes 63*a* are positioned to be shifted in the lining direction so that when the two plate materials are stacked, one long hole 63*a* formed in one plate material is communicated at the end thereof with the end of another long hole 63*a* formed in the other plate material.

The through holes of the communicating holes 6 and the long holes 63*a* may be in the shape of a circle, an ellipse or a polygon such as a triangle or a quadrangle. Alternatively, the long holes 63*a* may be in another random shape. These through holes and long holes 63*a* can be formed by etching or any other known method.

A pressure chamber part 3 made from a photosensitive glass with a thickness of approximately 200 μm is fixedly jointed onto the top face of the ink passage part 4. This pressure chamber part 3 forms the side walls of the plural pressure chamber recesses 32 each having the supply port 3*a* communicated with the orifice 3*c* and the discharge port 3*b* communicated with the ink discharging passage 42. The bottom walls of the recesses 32 are formed by the ink passage part 4.

The recesses 32 are opened so as to extend in the primary scanning direction on the top face of the head body 2 and are arranged at substantially equal intervals in the secondary scanning direction. The length and the width of the opening of each recess 32 are set to approximately 1250 μm and approximately 130 μm, respectively. The both ends of each recess 32 are in a substantially semi-circular shape.

On the other hand, the nozzle plate 5 of a stainless steel is fixedly jointed onto the bottom face of the ink passage part 4.

In the nozzle plate 5, a plurality of nozzles 51 for jetting ink drops onto the recording paper 14 are formed. Each nozzle 51 is communicated with the discharge port 3*b* of each recess 32 through the ink discharging passage 42. The plural nozzles 51 are arranged on the bottom face of the ink-jet head 1 in a line extending in the secondary scanning direction so as to form a nozzle line 51*a*. One nozzle line 51*a* is provided correspondingly to each of all the ink supplying passages 41 excluding one ink supplying passage 41B for the black ink. The one ink supplying passage 41B for the black ink is provided with two nozzle lines 51*a* at both ends thereof in the primary scanning direction. In a pair of adjacent nozzle lines 51*a*, the nozzles 51 of one nozzle line 51*a* are respectively disposed to be shifted from the nozzles 51 of the other nozzle line 51*a* by a half pitch in the secondary scanning direction (i.e., the lining direction of the nozzle line 51*a*).

Each nozzle 51 has a taper section in which the diameter of the nozzle is reduced toward the tip thereof and a straight section continued from the end of the taper section closer to the tip of the nozzle. The straight section has a diameter of approximately 20 μm.

The bottom face of the nozzle plate 5 is coated with a water repellent film (not shown). The water repellent film can be formed by any known method.

A piezoelectric actuator 21 is provided above each of the recesses 32 of the head body 2. The piezoelectric actuator 21 has a vibration plate 22 of Cr that is fixedly jointed to the top face of the head body 2 so as to cover each recess 32 of the head body 2 and to form the pressure chamber 31 together with the recess 32. One vibration plate 22 is shared by all the piezoelectric actuators 21 and also works as a common electrode shared by all piezoelectric devices 23 described later. The common electrode may be provided separately from the vibration plate 22.

Each piezoelectric actuator 21 includes the piezoelectric device 23 of lead zirconate titanate (PZT) and an individual electrode 24 of Pt for applying a voltage (driving voltage) to the piezoelectric device 23 together with the vibration plate 22. The piezoelectric device 23 is provided on a face of the vibration plate 22 opposite to the pressure chamber 31 (namely, on the upper face of the vibration plate 22) in a portion corresponding to the pressure chamber 31 (namely, in a portion opposing the opening of the recess 32) with an intermediate layer 25 of Cu sandwiched therebetween. The individual electrode 24 is jointed onto a face of each piezoelectric device 23 opposite to the vibration plate 22 (namely, on the upper face of the piezoelectric device 23).

The vibration plate 22, the piezoelectric devices 23, the individual electrodes 24 and the intermediate layers 25 are all made from thin films. The vibration plate 22 has a thickness of approximately 6 μm, each piezoelectric device 23 has a thickness of 8 μm or less (for example, approximately 3 μm), each individual electrode 24 has a thickness of approximately 0.2 μm, and each intermediate layer 25 has a thickness of approximately 3 μm.

Each piezoelectric actuator 21 applies the driving voltage to the corresponding piezoelectric device 23 via the vibration plate 22 and the corresponding individual electrode 24, so as to deform a portion of the vibration plate 22 corresponding to the pressure chamber 31 (namely, the portion corresponding to the opening of the recess 32), and thus, the ink contained in the pressure chamber 31 is discharged from the discharge port 3*b* and the nozzle 51. Specifically, when a pulse voltage is applied between the vibration plate 22 and the individual electrode 24, the piezoelectric device 23 shrinks owing to the piezoelectric effect in the width direction perpendicular to the thickness direction at the rise of the pulse voltage but the vibration plate 22, the individual electrode 24 and the intermediate layer 25 do not shrink. Therefore, the portion of the vibration plate 22 corresponding to the pressure chamber 31 is deformed into a convex shape protruding toward the pressure chamber 31 through what is called a bimetal effect. This deformation increases the pressure within the pressure chamber 31, and the increased pressure pushes out the ink contained in the pressure chamber 31 through the discharge port 3*b* and the ink discharging passage 42 from the nozzle 51. Then, the piezoelectric device 23 expands at the fall of the pulse voltage and the portion of the vibration plate 22 corresponding to the pressure chamber 31 is restored in its shape. At this point, the ink pushed out from the nozzle 51 is pulled off from the ink remaining in the ink passage 12 and jetted onto the recording paper 14 as ink drops (for example, 3 pl), so as to adhere onto the recording paper 14 in the form of dots. Also, when the vibration plate 22 restores from the deformed convex shape to the original shape, the ink is charged in the pressure chamber 31 from the ink cartridge 13 through the ink supplying passage 41 and the supply port 3*a*. The pulse voltage to be applied to each piezoelectric device 23 is not limited to the aforementioned push-pull type pulse voltage but may be a pull-push type pulse voltage that falls from a first voltage to a second voltage lower than the first voltage and then rises to the first voltage.

The application of the driving voltage to the respective piezoelectric devices 23 is performed at predetermined time intervals (for example, every approximately 50 μs; with a driving frequency of 20 kHz) while the ink-jet head 1 and the carriage 11 are moved in the primary scanning direction from one end to the other end of the recording paper 14 at a substantially constant speed. However, when the ink-jet head 1 reaches a portion of the recording paper 14 where no ink drops are to be adhered, the voltage is not applied. Thus, ink drops are made to impact on desired portions of the recording paper 14. When a recording operation for one scanning is completed, the recording paper 14 is transferred in the secondary scanning direction by a given amount by the transfer motor and the transfer rollers 15. Thereafter, ink drops are jetted while moving the ink-jet head 1 and the carriage 11 in the primary scanning direction again for a recording operation for another scanning. Such operations are repeated, so as to form a desired image on the whole recording paper 14.

When the ink is thus jetted from the nozzle 51 by driving the piezoelectric actuator 21, the meniscus vibration is caused at the tip opening of the nozzle 51. Due to the meniscus vibration, pressure waves are propagated through the ink discharging passage 42 and the pressure chamber 31 to the ink supplying passage 41. When the pressure waves propagated to the ink supplying passage 41 reach the damper wall 44, the damper wall 44 is deformed so as to absorb and eliminate the pressure waves. In this manner, the problem that an ink is jetted from another nozzle 51 due to the pressure waves propagated through the ink supplying passage 41 can be avoided.

In particular, since the port of the first communicating section 61 of the communicating hole 6 opened to the air chamber 43 is disposed away from the damper wall 44 in the stacking direction by the distance corresponding to the thickness of the plate material, the whole peripheral edge of the damper wall 44 is clipped and fixed by the plate materials included in the ink passage part 4. Therefore, no strain is caused in the deformation of the damper wall 44 but the damper wall 44 is uniformly deformed. As a result, the pressure waves can be definitely absorbed.

This ink-jet head 1 is fabricated by jointing the ink passage part 4 including a plurality of stacked and jointed plate materials with a first block obtained by previously jointing the piezoelectric actuators 21 to the pressure chamber part 3, and jointing the nozzle plate 5 to the resultant ink passage part 4.

The ink passage part 4 is obtained by applying an adhesive on the faces of the respective plate materials and jointing them with one another by stacking them. Since the ink passage part 4 is heated at this point, the air within the air chambers 43 is expanded and then shrunk afterward due to the temperature decrease. If the air chamber 43 is an enclosed space, the damper wall 44 remains to be deformed due to the pressure difference caused between the ink supplying passage 41 and the air chamber 43 by the temperature change occurring in the fabrication of the ink-jet head 1. However, the air chamber 43 of this embodiment is communicated with the atmospheric air through the communicating hole 6, and therefore, the pressure within the air chamber 43 is always the atmospheric pressure. Accordingly, the damper wall 44 can be prevented from remaining to be deformed. Also, even when the ambient temperature is changed during the operation of the ink-jet head 1, since the air chamber 43 is communicated with the atmospheric air, the pressure within the air chamber 43 is always the atmospheric pressure.

Accordingly, the pressure waves can be definitely absorbed by the damper wall 44. As a result, the ink can be stably jetted from the nozzle 51, so as to improve the reliability of the ink-jet head 1 and improve the recording quality of the recording apparatus A.

Furthermore, the communicating hole 6 is constructed from the through holes (long holes 63*a*) provided in the plate materials included in the ink passage part 4 (as shown in FIG. 8). Therefore, lowering in the strength of the plate materials otherwise caused before stacking the plate materials can be suppressed. As a result, components can be easily dealt with in the fabrication of the ink-jet head.

In Embodiment 1, a plurality of ink supplying passages 41 and air chambers 43 are provided correspondingly to the colors of the ink and each air chamber 43 is provided with a plurality of communicating holes 6, which does not limit the invention. Instead, one communicating hole 6 may be provided correspondingly to each color of the ink. In other words, one communicating hole 6 may be shared by a plurality of air chambers 43.

Also, there is no need to dispose the air chamber 43 and the damper wall 44 in the positions opposing each ink supplying passage 41 in the stacking direction. The air chamber 43 and the damper wall 44 may be disposed in other positions, such as positions opposing the side wall of each ink supplying passage 41.

Modification 1

Figure 9:
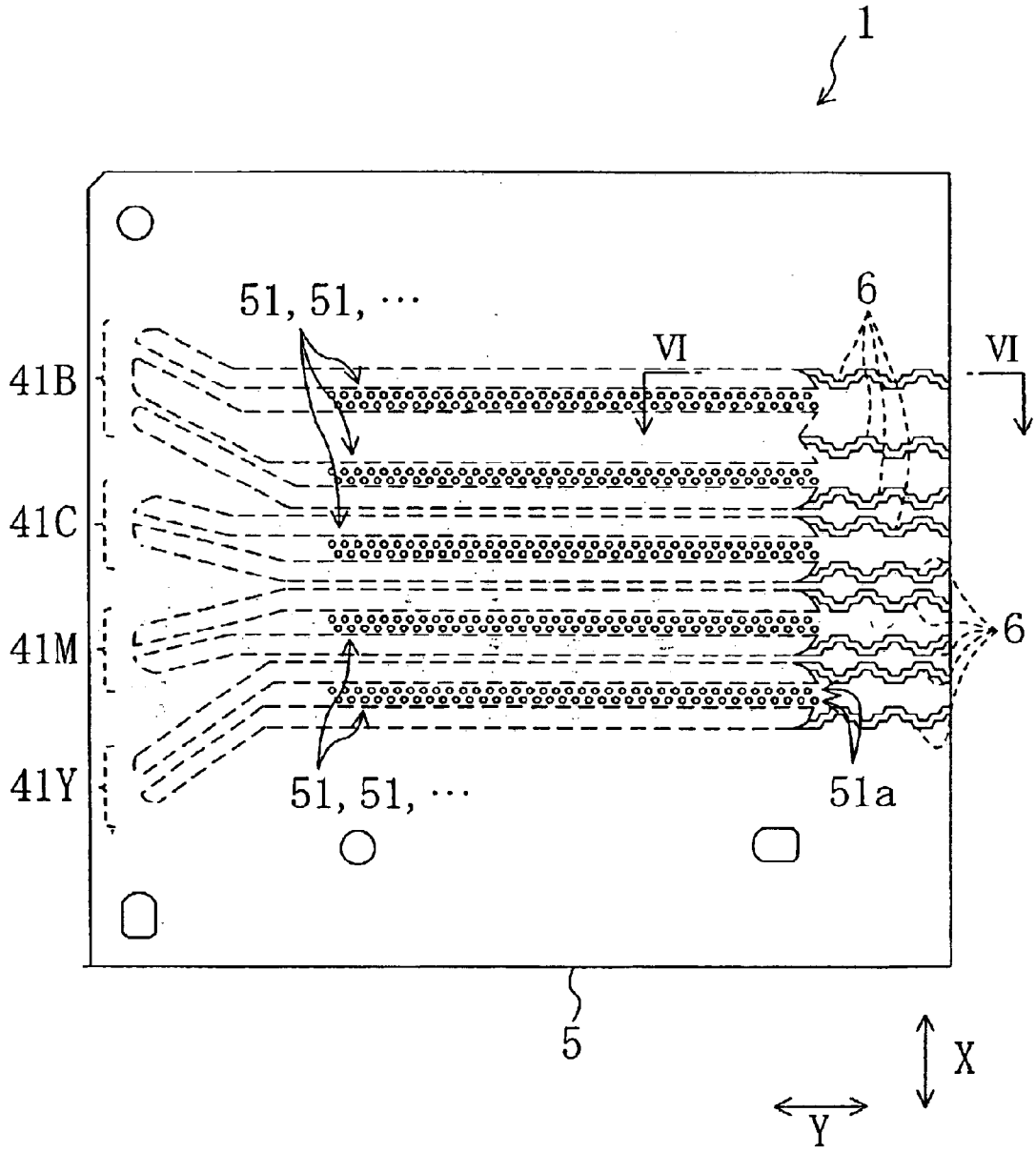
FIG. 9 is a bottom view corresponding to FIG. 5 of an ink-jet head according to Modification 1.
Figure 10:
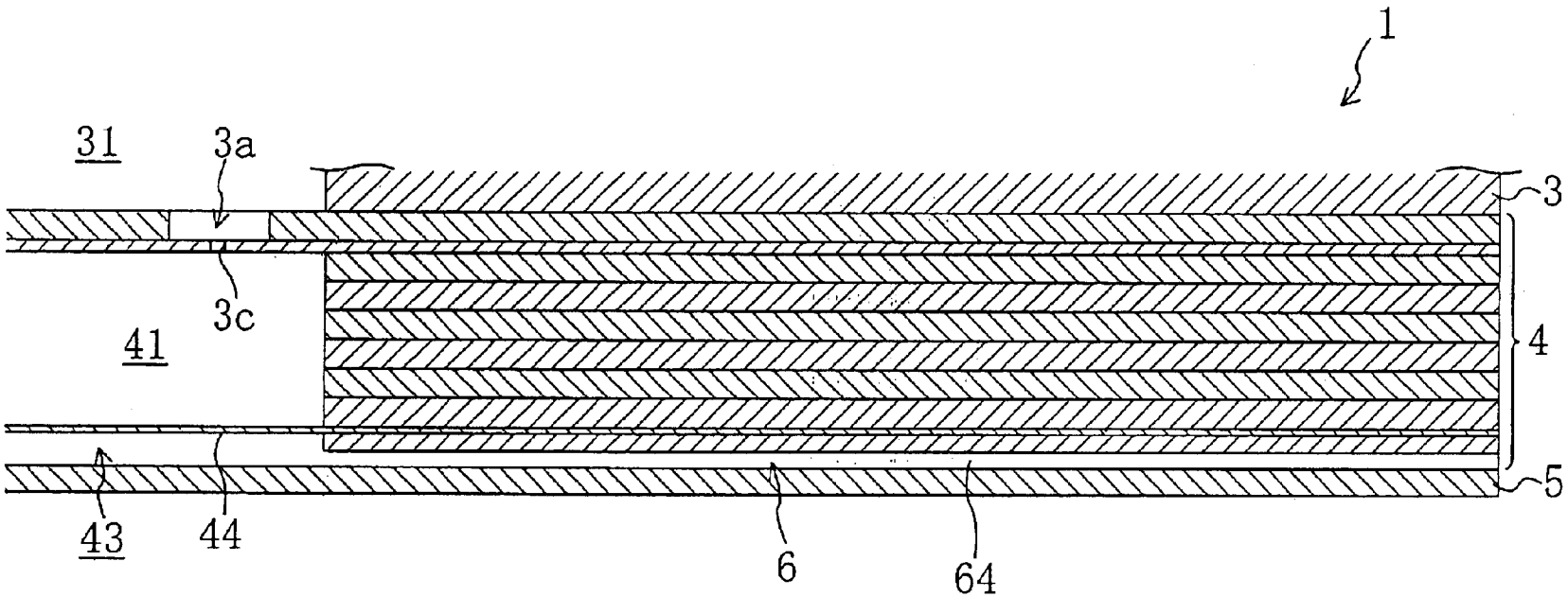
FIG. 10 is a cross-sectional view taken on line VI—VI of FIG. 9.
Figure 11:
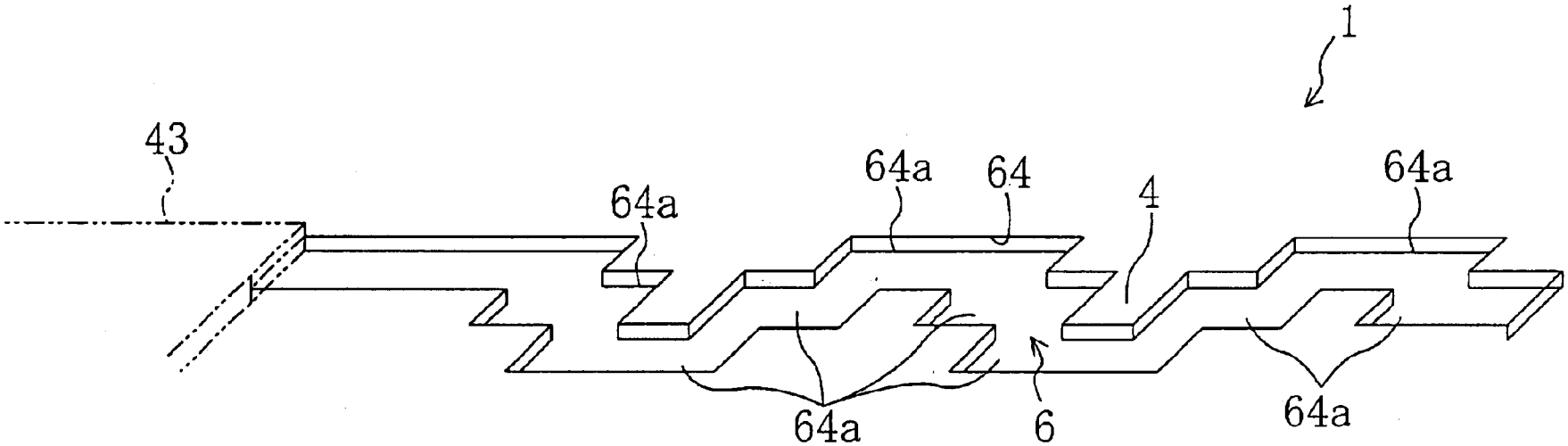
FIG. 11 is a perspective explanatory diagram corresponding to FIG. 7 for showing the structure of a communicating hole according to Modification 1.

In Modification 1 of Embodiment 1, a communicating hole 6 is constructed from an expanding slot 64 formed in a plate material included in an ink passage part 4 as shown in FIGS. 9 through 11. In an ink-jet head 1 according to this modification, like reference numerals are used to refer to like elements used in Embodiment 1 so as to omit the description.

The expanding slot 64 is formed in the lower plate material out of the two plate materials disposed below the plate material used as the damper wall 44. The expanding slot 64 extends from the air chamber 43 in the secondary scanning direction to be opened at the end of the plate material. When respective components are stacked, the side wall of the communicating hole 6 is formed by the plate material having the expanding slot 64, the top wall of the communicating hole 6 is formed by the plate material disposed above, and the bottom wall of the communicating hole 6 is formed by the nozzle plate 5.

The expanding slot 64 is formed by communicating a plurality of long holes 64*a* with one another in the secondary scanning direction. Two long holes 64*a* adjacent to each other in the secondary scanning direction are disposed to be shifted from each other in the primary scanning direction. Thus, the expanding slot 64 is formed from the air chamber 43 to the side face of the ink passage part 4 in a zigzag manner.

When the ink-jet head 1 is provided with such a communicating hole 6, the pressure within the air chamber 43 can be always the atmospheric pressure as in Embodiment 1. Therefore, the pressure waves can be definitely absorbed by the damper wall 44. As a result, the ink can be stably jetted from the nozzle 51, so as to improve the reliability of the ink-jet head 1 and improve the recording quality of the recording apparatus A.

Also, since the expanding slot 64 used as the communicating hole 6 is formed in a zigzag manner, the lowering of the strength of the plate material having the expanding slot 64 can be suppressed. As a result, the plate material can be easily dealt with in the fabrication of the ink-jet head 1.

Modification 2

Figure 12:
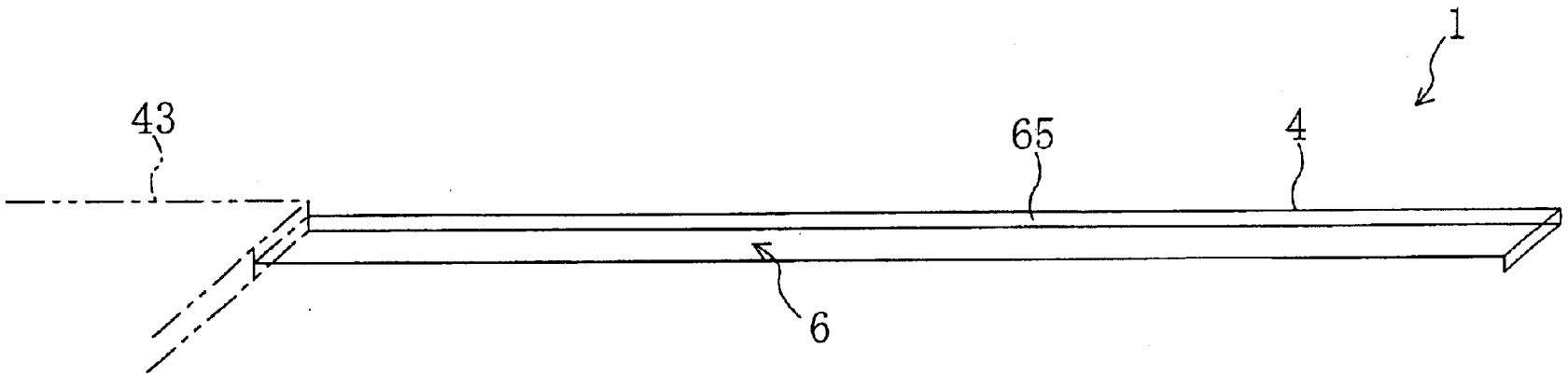
FIG. 12 is a perspective explanatory diagram corresponding to FIG. 7 for showing the structure of a communicating hole according to Modification 2.

In Modification 2 of Embodiment 1, a communicating hole 6 is constructed from an expanding slot 65 formed in a predetermined one of plate materials included in an ink passage part 4 as shown in FIG. 12. Differently from Modification 1, this expanding slot 65 is linearly formed.

Also when the communicating hole 6 is constructed from such a linear expanding slot 65, an air chamber 43 is communicated with the atmospheric air so that the pressure within the air chamber 43 can be always the atmospheric pressure. As a result, the ink can be stably jetted from the nozzle 51, so as to improve the reliability of an ink-jet head 1.

However, since the expanding slot 65 is linearly formed, the strength of the plate material having the expanding slot 65 may be lowered. Therefore, from the viewpoint of easiness in dealing with the plate material, the zigzag expanding slot 64 of Modification 1 is preferred.

Modification 3

In Modification 3 of Embodiment 1, a communication hole 6 extends not in the secondary scanning direction but in the vertical direction.

Figure 13:
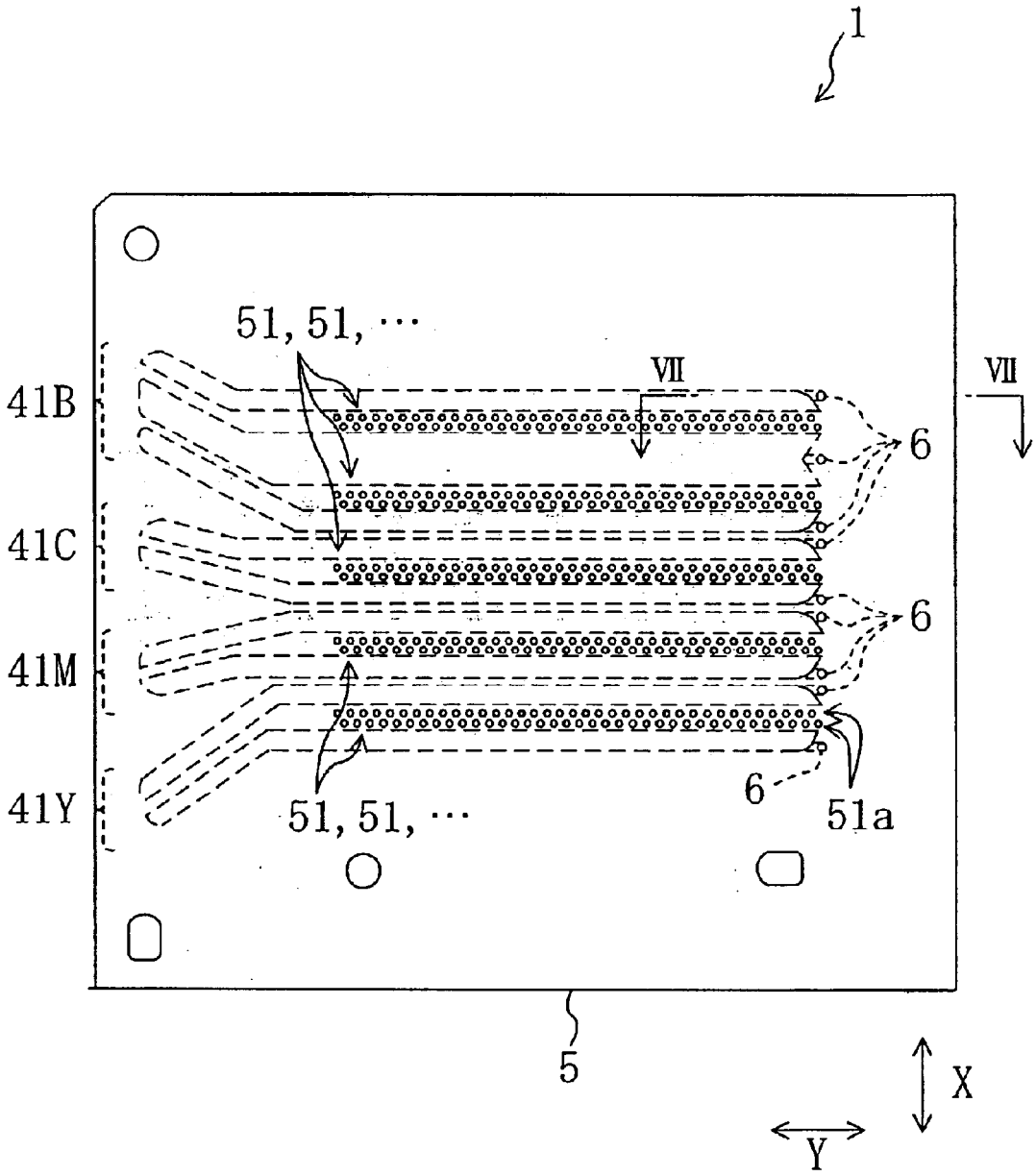
FIG. 13 is a bottom view corresponding to FIG. 5 of an ink-jet head according to Modification 3.
Figure 14:
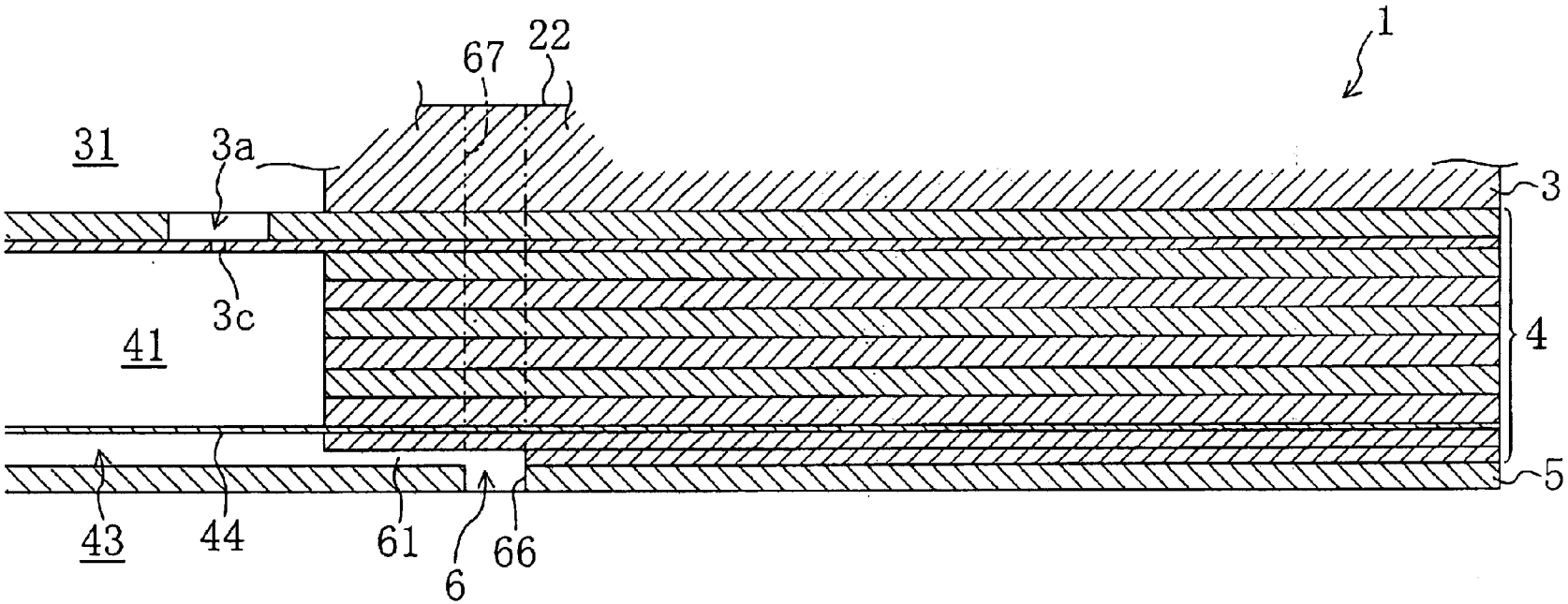
FIG. 14 is a cross-sectional view taken on line VII—VII of FIG. 13.

Specifically, as shown in FIGS. 13 and 14, the communicating hole 6 of Modification 3 consists of a communicating section 61 and a main section 66. The communicating section 61 is constructed from a long hole (penetrating in the thickness direction) formed, in the secondary scanning direction, in the lower plate material out of the two plate materials disposed below the plate material used as the damper wall 44. The main section 66 is constructed from a through hole formed continuously from the end of the long hole in the nozzle plate 5.

Also in this manner, the air chamber 43 is communicated with the atmospheric air through the communicating hole 6, so that the pressure within the air chamber 43 can be always the atmospheric pressure. As a result, the pressure waves can be definitely absorbed by the damper wall 44, and the ink can be stably jetted from the nozzle 51 so as to improve the reliability of the ink-jet head 1 and improve the recording quality of the recording apparatus A.

Also, the communicating hole 6 can be formed merely by forming through holes respectively in the plate material of the ink passage part 4 and the nozzle plate 5. Therefore, the lowering of the strength of the plate materials (the plate material and the nozzle plate 5) can be prevented, and hence, the respective plate materials can be easily dealt with in the fabrication of the ink-jet head 1.

The communicating hole 6 may be opened on the top face of the ink-jet head 1 as shown with two-dot chain lines in FIG. 14. Specifically, through holes are formed not only in the respective plate materials included in the ink passage part 4 but also in the pressure chamber part 6 and the vibration plate 22 of the piezoelectric actuator 21. These through holes are formed so as to communicate with one another when the components are stacked.

Also in this manner, the communicating hole 6 can be formed by forming the through holes in the respective plate materials of the ink passage part 4, the pressure chamber part 6 and the vibration plate 22. Therefore, the lowering of the strength of the respective plate materials can be prevented, and hence, the respective plate materials can be easily dealt with in the fabrication of the ink-jet head 1.

Embodiment 2

Figure 15:
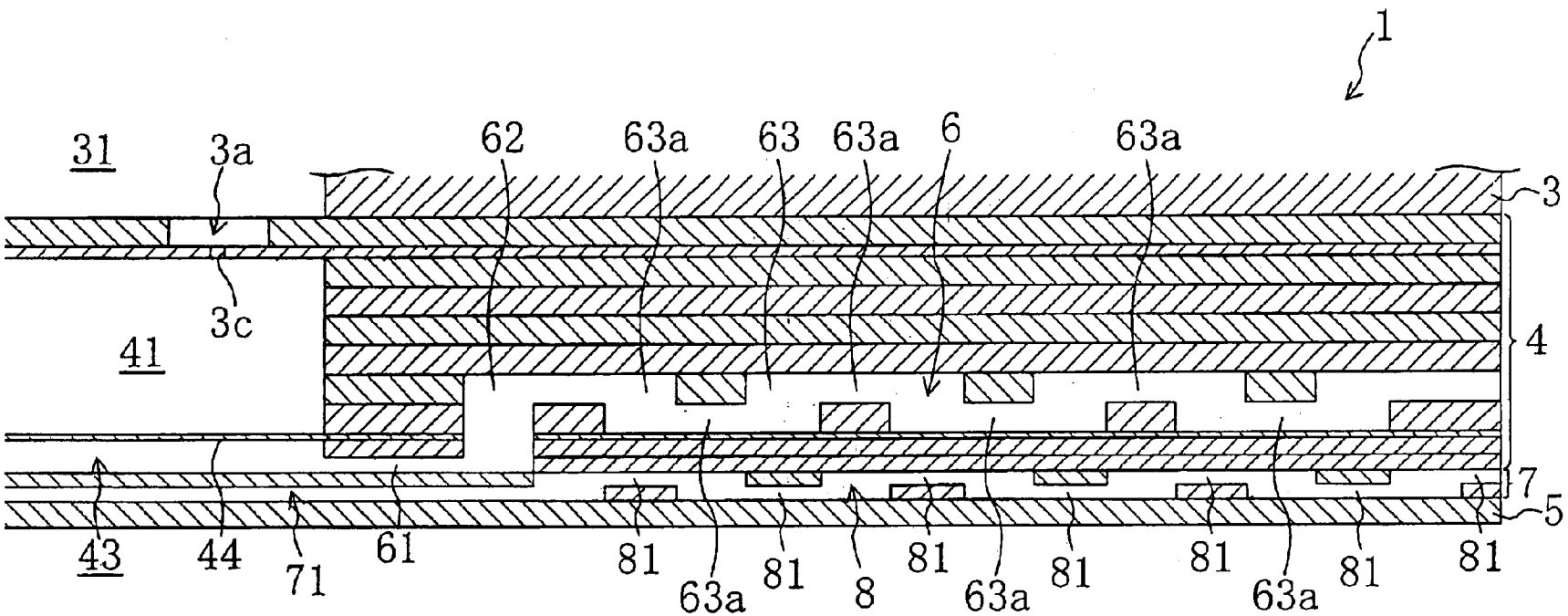
FIG. 15 is a partial cross-sectional view corresponding to FIG. 6 of an ink-jet head according to Embodiment 2 of the invention.

In Embodiment 2 of the invention, a protection part 7 is provided between an ink passage part 4 and a nozzle plate 5 as shown in FIG. 15. Thus, a communicating hole 6 formed in the ink passage part 4 can be protected.

An ink-jet head 1 of this embodiment has a basic structure substantially the same as that of Embodiment 1, and therefore, like reference numerals are used to refer to like elements to omit the description, and a difference alone will be herein described.

The protection part 7 consists of two plate materials stacked between the ink passage part 4 and the nozzle plate 5. The protection part 7 includes a second air chamber 71 and a second communicating hole 8.

The second air chamber 71 is formed in a position opposing, in the stacking direction, the air chamber 43 of the ink supplying passage 41. Also, the second communicating hole 8 is formed in a position opposing, in the stacking direction, the communicating hole 6 so as to extend in the secondary scanning direction. The second communicating hole 8 is formed for communicating the second air chamber 71 with the atmospheric air.

The second communicating hole 8 is constructed from through holes (long holes) formed in the two plate materials included in the protection part 7 in the same manner as the main section 63 of the communicating hole 6. Specifically, a plurality of long holes 81 penetrating in the thickness direction are formed in each of the two plate materials so as to be arranged in a line at substantially equal intervals. The long holes 81 are formed in positions shifted in the lining direction so that one long hole 81 formed in one plate material can be communicated with another long hole 81 formed in the other plate material at the ends thereof when the plate materials are stacked. Also, the respective long holes 81 of the second communicating hole 8 are formed in positions shifted in the lining direction from the long holes 63*a* of the communicating hole 6 (main section 63).

In the fabrication of the ink-jet head 1, the piezoelectric actuator 21, the pressure chamber part 3 and the ink passage part 4 are jointed with one another, and the nozzle plate 5 is jointed to the resultant. Since spaces are formed by the communicating holes 6 within the ink passage part 4, the strength is lowered in these spaces.

Therefore, the protection part 7 is disposed between the ink passage part 4 and the nozzle plate 5. Thus, the communicating holes 6 (spaces) can be protected, so that the components can be easily dealt with in the fabrication of the ink-jet head 1.

Furthermore, since the protection part 7 includes the second air chamber 71 and the second communicating hole 8, when the nozzle plate 5 is jointed to the protection part 7, the air expanding between the protection part 7 and the nozzle plate 5 can escape to the outside of the ink-jet head 1 through the second air chamber 71 and the second communicating hole 8. Therefore, no void is formed in a joint layer between the protection part 7 and the nozzle plate 5. As a result, the nozzles 51 of the nozzle plate 5 can be prevented from communicating with each other.

Moreover, in the fabrication of the ink-jet head 1, the ink passage part 4 and the protection part 7 are stacked on and jointed with each other by heating these parts under a pressure applied in the stacking direction. At this point, if the long holes 63*a* of the communicating hole 6 (main section 63) are disposed in the same positions in the lining direction as the long holes 81 of the second communicating hole 8, the space formed by each long hole 63*a* of the communicating hole 6 is adjacent to the space formed by each long hole 81 of the second communicating hole 8 in the stacking direction. Therefore, even when the pressure is applied in the stacking direction, it cannot be definitely transmitted in the stacking direction due to these spaces. As a result, a joint failure may be caused.

In contrast, when the long holes 81 of the second communicating hole 8 are shifted in the positions in the lining direction from the long holes 63*a* of the communicating hole 6 as in Embodiment 2, the space formed by each communicating hole 6 and the space formed by each second communicating hole 8 are never adjacent to each other in the stacking direction. Therefore, when the pressure is applied with these parts stacked, the pressure can be definitely transmitted in the stacking direction, so that the respective parts can be definitely jointed to each other.

The structures of the communicating hole 6 and the second communicating hole 8 are not limited to those described above. For example, each of the communicating hole 6 and the second communicating hole 8 can be formed in the structure described in any of Modifications 1 through 3 of Embodiment 1.

Figure 16:
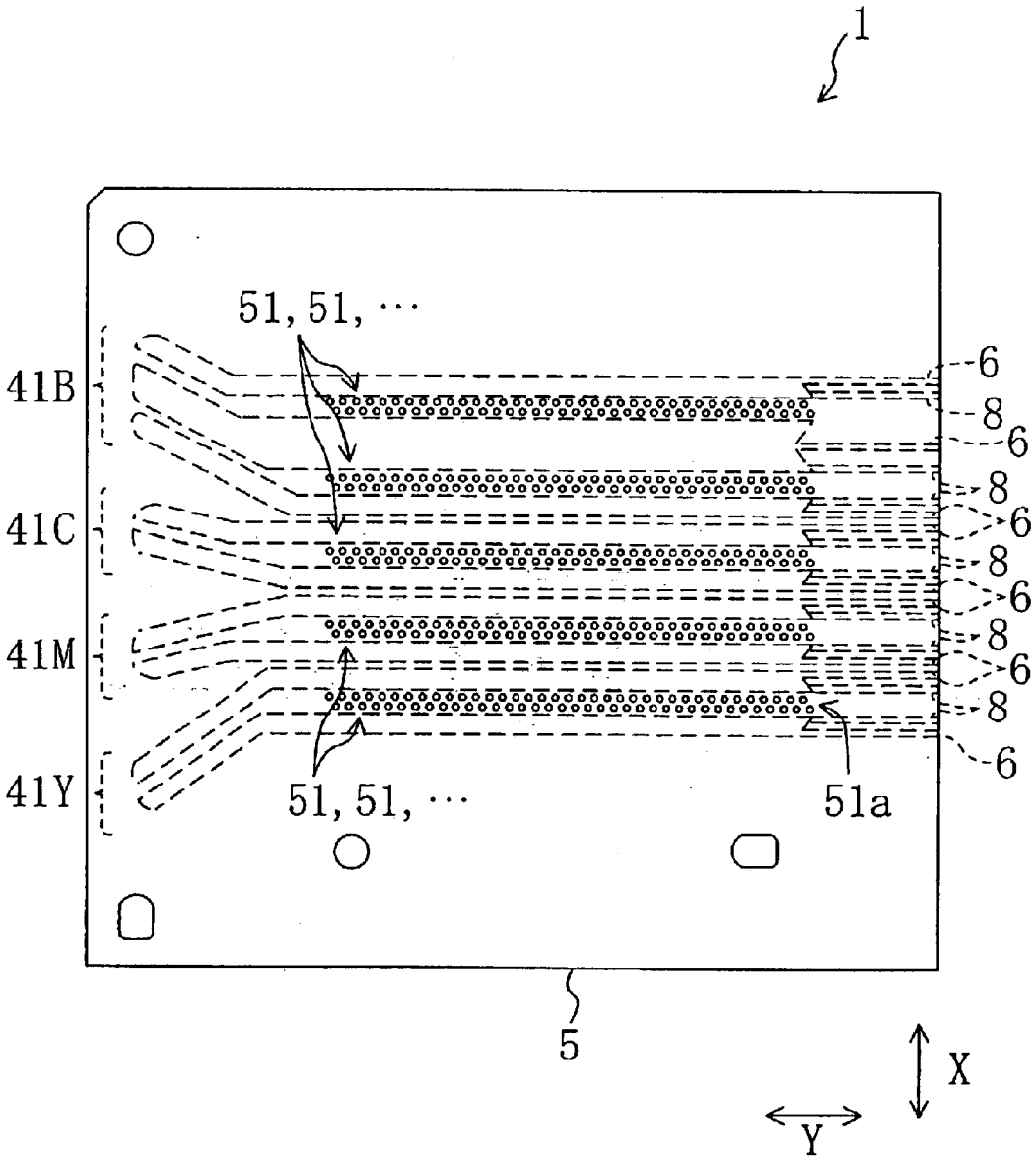
FIG. 16 is a bottom view corresponding to FIG. 5 of an ink-jet head according to a modification of Embodiment 2.

Furthermore, the communicating hole 6 and the second communicating hole 8 may be disposed, for example, in positions shifted from each other in a direction perpendicular to the stacking direction as shown in FIG. 16. Thus, the space formed by the second communicating hole 8 and the space formed by the communicating hole 6 can be prevented from being adjacent to each other in the stacking direction. Therefore, the respective parts can be definitely jointed to each other in the fabrication of the ink-jet head 1.

What is claimed is:

1. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air, said communicating hole extends along a nozzle column and is opened on a side face of said ink passage part.

2. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air;

wherein said ink passage part includes a plurality of plate materials stacked between said nozzle plate and said pressure chamber part, and said communicating hole extends within said ink passage part in a direction perpendicular to a stacking direction and is opened on a side face of said ink passage part.

3. The ink-jet head of claim 2, wherein said communicating hole consists of a plurality of long holes that are respectively formed to penetrate, in a thickness direction, given two adjacent plate materials out of said plurality of plate materials and are arranged in a line at substantially equal intervals, said long holes formed in one of said two plate materials are shifted in positions thereof in a lining direction from said long holes formed in the other of said two plate materials in such a manner that an end of one long hole formed in one plate material is communicated with an end of another long hole formed in the other plate material when said two plate materials are stacked.

4. The ink-jet head of claim 2, wherein said communicating hole is an expanding slot that is formed in a given plate material out of said plurality of plate materials and is opened at an end of said given plate material.

5. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air, wherein said ink passage part includes a plurality of plate materials stacked between said nozzle plate and said pressure chamber part, and said communicating hole extends within said ink passage part in a stacking direction and is opened on an exposed face of said pressure chamber part.

6. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air, wherein said ink supplying passage includes a plurality of ink supplying passages for respectively supplying inks of different colors, said air chamber includes a plurality of air chambers, respectively corresponding to said plurality of ink supplying passages, separated by said damper wall, and said communicating hole includes a plurality of communicating holes respectively corresponding to said plurality of air chambers.

7. The ink-jet head of claim 6, wherein each of said plurality of ink supplying passages for said inks of different colors further includes a plurality of ink supplying passages, said air chamber includes a plurality of air chambers, respectively corresponding to said plurality of ink supplying passages for said inks of different colors, separated by said damper wall, and said communicating hole includes a plurality of communicating holes respectively corresponding to said plurality of air chambers.

8. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air, wherein a port for communicating said communicating hole with said air chamber is disposed to have an edge thereof in a position away from said damper wall in a stacking direction.

9. An ink-jet head comprising:

a pressure chamber part in which a pressure chamber charged with an ink is formed;

a nozzle plate in which a nozzle for discharging said ink is formed;

an ink passage part disposed between said pressure chamber part and said nozzle plate in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber;

a communicating hole for communicating said air chamber with the atmospheric air; and a protection part disposed between said ink passage part and said nozzle plate for protecting said communicating hole.

10. An ink-jet head comprising:

a pressure chamber charged with an ink;

an ink supplying passage communicated with said pressure chamber for supplying said ink to said pressure chamber;

a nozzle communicated with said pressure chamber through an ink discharging passage;

an actuator for applying a pressure to said pressure chamber for discharging said ink charged in said pressure chamber from said nozzle;

a damper wall with flexibility disposed as one of partition walls for separating said ink supplying passage;

an air chamber provided on a side of said damper wall opposite to said ink supplying passage; and a communicating hole for communicating said air chamber with the atmospheric air, said communicating hole extends along a nozzle column and is opened on a side face of said ink-jet head.

11. An ink-jet head comprising:

a nozzle;

a pressure chamber communicated with said nozzle and charged with an ink;

an ink supplying passage communicated with said pressure chamber for supplying said ink to said pressure chamber;

pressure applying means for applying a pressure to said pressure chamber for discharging said ink from said nozzle; and pressure absorbing means including an air chamber for absorbing pressure variation of said ink within said ink supplying passage, wherein said air chamber of said pressure absorbing means is communicated with the atmospheric air via a communicating hole extending along a nozzle column and opening on a side face of said ink-jet head.

12. A recording apparatus comprising an ink-jet head for performing recording by jetting ink drops onto a recording medium from a nozzle of said ink-jet head, wherein said ink-jet head includes:

a pressure chamber part in which a pressure chamber charged with an ink is formed;

a nozzle plate in which said nozzle for discharging said ink is formed;

an ink passage part disposed between said pressure chamber part and said nozzle plate, in which an ink supplying passage communicated with said pressure chamber for supplying said ink to said pressure chamber and an ink discharging passage for communicating said pressure chamber with said nozzle are respectively formed;

an actuator, stacked on said pressure chamber part, for applying a pressure to said pressure chamber for discharging said ink charged in said pressure chamber from said nozzle;

an air chamber provided in said ink passage part in a position opposing said ink supplying passage;

a damper wall with flexibility for separating said ink supplying passage from said air chamber; and a communicating hole for communicating said air chamber with the atmospheric air, said communicating hole extends along a nozzle column and is opened on a side face of said ink passage part.

13. A recording apparatus comprising an ink-jet head for performing recording by jetting ink drops onto a recording medium from a nozzle of said ink-jet head, wherein said ink-jet head includes:

a pressure chamber charged with an ink;

an ink supplying passage communicated with said pressure chamber for supplying said ink to said pressure chamber;

said nozzle communicated with said pressure chamber through an ink discharging passage;

an actuator for applying a pressure to said pressure chamber for discharging said ink charged in said pressure chamber from said nozzle;

a damper wall with flexibility disposed as one of partition walls for separating said ink supplying passage;

an air chamber provided on a side of said damper wall opposite to said ink supplying passage; and a communicating hole for communicating said air chamber with the atmospheric air, said communicating hole extends along a nozzle column and is opened on a side face of said ink-jet head.

14. A recording apparatus comprising an ink-jet head for performing recording by jelling ink drops onto a recording medium from a nozzle of said ink-jet head, wherein said ink-jet head includes:

a pressure chamber communicated with said nozzle and charged with an ink;

an ink supplying passage communicated with said pressure chamber for supplying said ink to said pressure chamber;

pressure applying means for applying a pressure to said pressure chamber for discharging said ink from said nozzle; and pressure absorbing means including an air chamber for absorbing pressure variation of said ink within said ink supplying passage, and said air chamber of said pressure absorbing means is communicated with the atmospheric air via a communicating hole extending along a nozzle column and opening on a side face of said ink-jet head.

* * * * *